United States Patent [19]

Castellucci et al.

[11] 4,053,329

[45] Oct. 11, 1977

[54] METHOD OF IMPROVING CORROSION RESISTANCE OF METAL SUBSTRATES BY PASSIVATING WITH AN ONIUM SALT-CONTAINING MATERIAL

[75] Inventors: Nicholas T. Castellucci, Pittsburgh; Joseph F. Bosso, Lower Burrell, both of Pa.

[73] Assignee: PPG Industries, Inc., Pittsburgh, Pa.

[21] Appl. No.: 673,170

[22] Filed: Apr. 2, 1976

[51] Int. Cl.[2] ..... C23F 9/02; C23F 7/10

[52] U.S. Cl. ..... 148/6.15 R; 148/6.14 R; 148/6.15 Z; 148/6.24; 148/31.5; 427/327; 427/328

[58] Field of Search ..... 148/6.15 R, 6.14 R, 148/6.24, 6.14 Z; 21/2.5 A, 2.7 R, 2.7 A; 252/389 A, 390, 395, 394; 427/327, DIG. 4, 309, 327; 134/3

[56] References Cited

U.S. PATENT DOCUMENTS

| | | | |
|---|---|---|---|
| 2,941,949 | 6/1960 | Saukaitis | 148/6.14 R |
| 3,036,305 | 5/1962 | Channabasoppa et al. | 252/390 |
| 3,136,663 | 6/1964 | McDonald | 148/6.14 R |
| 3,330,672 | 7/1967 | Kroll et al. | 252/395 |
| 3,359,322 | 12/1967 | Ratts | 252/393 |
| 3,387,954 | 6/1968 | Capowski et al. | 252/389 A |
| 3,493,440 | 2/1970 | Ashdown | 148/6.15 R |
| 3,664,807 | 5/1972 | Redmore | 21/2.7 A |
| 3,668,137 | 6/1972 | Gardner | 21/2.7 R |

*Primary Examiner*—Ralph S. Kendall
*Attorney, Agent, or Firm*—William J. Uhl

[57] ABSTRACT

A method of providing improved corrosion resistance to coated metal substrates is disclosed. The process of the invention involves a passivating pretreatment with an onium salt before coating. The invention is particularly effective with ferrous metal substrates.

18 Claims, No Drawings

METHOD OF IMPROVING CORROSION RESISTANCE OF METAL SUBSTRATES BY PASSIVATING WITH AN ONIUM SALT-CONTAINING MATERIAL

BACKGROUND OF THE INVENTION

1. Field of the Invention

The present invention relates to pretreating and passivating metal substrates to provide corrosion resistance to the metal substrates which are to be subsequently coated.

2. Brief Description of the Prior Art:

It is well known in the prior art that chromic acid pretreatments passivate and improve the corrosion resistance and coating properties of metal, particularly ferrous metal substrates. However, chromic acid pretreatments are undersirable because they are toxic and their effluents create serious pollution problems. The present invention resides in the discovery that specific onium salts can be used in a passivating pretreatment process for metal substrates, particularly ferrous metal substrates. The onium salts employed in the present invention are not toxic, do not present the serious pollution problems associated with chromic acid pretreatments, and have been found to provide excellent corrosion resistance to the treated metal substrates. Subsequently coating with a layer of paint provides a metal substrate with outstanding corrosion resistance.

SUMMARY OF THE INVENTION

The present invention provides a method of improving corrosion resistance to metal substrates, particularly ferrous metal substrates. The method comprises first passivating the surface of the substrate by pretreatment with an onium salt followed by direct coating of the pretreated metal surface. Examples of onium salts are those selected from the class consisting of: $(R)_4N^+A^-$, $(R)_4P^+A^-$ and $(R)_3S^+A^-$ where R are organic radicals and A is an anion of an acid which will not detrimentally attack the surface of the substrate.

In a preferred embodiment of the invention, the onium salt is a monomeric phosphonium salt such as ethyl triphenyl phosphonium acetate and tetrabutyl phosphonium acetate. In a second preferred embodiment of the invention, the onium salt is a quaternary ammonium salt derived from a polyepoxide.

The term "passivating" means rendering the surface of the substrate resistant to corrosion without applying a visually detectable coating. The amount of pretreating material applied to the surface of the substrate is less than about 100 milligrams per square foot (328 milligrams per square meter). Thus, the passivating pretreatment of the present invention is distinguished from the coating of metal substrates with corrosion inhibiting primers. Also, the passivated metal surface obtained by pretreating in accordance with the present invention is electrically conductive such that it can be subsequently electrocoated. When the pretreated metal surface is made a cathode and immersed in a 10 percent resin solids electrodeposition bath (bath temperature 15° C.) containing the resin of Example A and an electric potential of 200 volts applied to the bath, a continuous film of about 0.4 to 1.0 mil (0.1 to $2.54 \times 10^{-2}$ millimeters) is deposited in about 60 to 120 seconds. Most corrosion inhibiting primers cannot be subsequently electrocoated unless they contain specially added electroconductive pigments.

The improved resistance to corrosion provided by the passivating pretreatment of the present invention can be determined by comparing salt spray corrosion of coated steel panels which have, and have not been pretreated in accordance with the present invention.

The expression "direct coating" as used in the specification and claims means that after the passivating pretreatment, the metal substrate is coated without cleaning or degreasing treatments.

PERTINENT PRIOR ART

U.S. Pat. No. 2,340,996 discloses treating metal surfaces with onium salts dissolved in a hydrocarbon oil. The reference is pertinent to the present invention because it discloses the use of onium salts to retard rusting of metal surfaces. However, the process described in the reference differs from the present invention in that it is not a passivating pretreatment but is a process for protecting "pickled" steel.

U.S. Pat. No. 3,885,913 discloses the use of quaternary ammonium salts of polyepihalohydrins as corrosion inhibitors in pickling solutions. Pickling solutions are highly acidic and are used to treat rusted ferrous metal surfaces. Such a highly acidic medium would not be applicable in the practice of the invention where the treated metal surface must be directly coated. Treatment with a highly acidic medium would make the treated metal surface prone to rapid corrosion and would probably require the application of an oil to the surface to prevent further rusting. Such an oil, of course, would have to be removed before coating.

U.S. Pat. No. 3,365,313 discloses water-insoluble organic quaternary ammonium complexes for use as corrosion-resistant pigments in primer paint formulations. The quaternary ammonium complexes are formed by reacting water-soluble quaternary ammonium compounds with complex heteropolyanionic acids. Although this reference deals with quaternary ammonium salts for providing corrosion protection, the reference fails to disclose a passivating pretreatment as is required by the present invention. The depositing of a corrosion resistant primer coating is different than a passivating pretreatment in which there is no visually detectable coating.

U.S. Pat. No. 3,260,673 discloses the addition of quaternary ammonium-containing compounds in admixture with an inorganic iodide or bromide and a primary or secondary amine to phosphoric acid to prevent the acid from corroding metal. This permits corrosive phosphoric acid to be transported in metal containers. There is no disclosure in this reference of a combined passivating pretreatment-direct coating as is required in the present invention.

U.S. Pat. No. 3,201,467 discloses quaternary ammonium bases containing at least one propargyl or 3-hydroxy methyl propargyl (4-hydroxy-2-butenyl) radical. These particular quaternary ammonium compounds are added to acidic media to function as corrosion inhibitors for metal in contact with the acidic media. Once again, there is no disclosure in the reference of the passivating pretreatment-direct coating required by the present invention.

U.S. Pat. No. 3,147,244 discloses a metal cleaning composition which includes a quaternary ammonium compound having the following general formula:

$[(R)_3N - CH_2 -\text{to } C \equiv CH]^+X^-$ where X is a halide. Once again, as discussed in connection with the above-mentioned two references, there is no disclosure in this particular reference of a passivating pretreatment followed by a direct coating as required by the present invention.

U.S. Pat. No. 3,079,221 discloses quaternary ammonium compounds prepared from polymeric fatty acid amines for use as corrosion inhibitors. The inhibitors are added to the corrosion-causing medium such as water or a mineral acid to protect metal surfaces in contact with the corrosion-causing medium. The corrosion inhibitors are disclosed as being particularly useful for ferrous metals. The compositions are disclosed as being utilized in chemical processing industries, oil refining and processing equipment and in protection of pipe lines. Other illustrative applications are additives for protective coatings, industrial water treatment and as mineral acid inhibition additives. There is no disclosure in the patent of using these particular compounds in the method of the present invention, that is, for a passivating metal pretreatment followed by direct coating.

U.S. Pat. No. 3,036,305 relates to specific quaternary ammonium compounds as corrosion inhibitors in water circulation systems. The quaternary ammonium-containing compounds are added to water, thus protecting against corrosion by being constantly in contact with the metal through which the water circulates. This process is far different than that required by the present invention which deals with a passivating pretreatment of a metal surface followed by direct coating.

U.S. Pat. No. 3,664,807 discloses quaternary phosphonium compounds or polymers for use in preventing corrosion of metals. Once again, the particular quaternary phosphonium compounds and polymers disclosed in this reference are added to the medium which causes corrosion, that is, brines, weak organic acids, organic acids, $CO_2$, $H_2S$, etc., and thus protect the metal surface by being in constant contact therewith. Once again, there is no teaching in this reference of passivating pretreatment-direct coating operation as is required by the present invention.

U.S. Pat. Nos. 2,941,949; 3,764,543 and 3,773,675 disclose ternary sulfonium salts as corrosion inhibitors in aqueous acid cleaning solutions. As mentioned above, cleaning the surface of a metal with aqueous mineral acid is a far different process than a passivating pretreatment step such as is required in the practice of the present invention. Metal surfaces which have been cleaned with aqueous acid are not particularly desirable in the practice of the invention requiring a direct coating.

DETAILED DESCRIPTION

The onium-containing compounds useful in the practice of the invention can be represented by the following structural formulas:

$$(R)_4N^+A^-,\ (R)_4P^+A^-,\ (R)_3S^+A^-$$

Thus, quaternary ammonium, quaternary phosphonium and ternary sulfonium salt-containing materials can be employed.

R in the above structural formula are organic moieties and can be alkyl groups such as methyl, ethyl, propyl, butyl, pentyl, and higher groups such as decyl, hexadecyl, etc. The alkyl groups can be straight chain or branched. The organic moieties represented by R can also be alkenyl. Examples include vinyl and allyl groups and other unsaturated groups having 2 or more carbon atoms, as high as 18 or more carbons, which have one or more unsaturated groups such as linolyl, linolenyl, etc. Also, alkynyl groups are represented. Examples include propargyl and other acetylenic unsaturated groups having 2 or more carbon atoms having one or more acetylenic groups. R can be represented by aryl moieties such as phenyl, naphthyl, anthracyl, diphenyl, etc. Also, substituted aryl such as $R'_n$—B— where B is an aryl group and R′ is the substituted group, the maximum value of $n$ is determined by the available substitutable groups on B. R′ may be another aryl group, alkyl, cycloalkyl, alkenyl, alkynyl and substituted derivatives thereof. R can also be represented by cycloalkyl, cycloalkenyl and cycloalkynyl groups. Examples include cyclopentyl, cyclohexyl, cyclohexenyl and cyclohexynyl. Also, R can be represented by heterocyclic groups such as furfuryl, pyridyl and thiophenyl.

Any of the above groups may be substituted with non-carbon atoms such as oxygen, nitrogen, sulfur and halogen. Two or more of the R groups may be the same or each may be different.

The onium salt can be a polymer which contains onium salt groups, in which the onium salt groups are pendant, such as, for example,

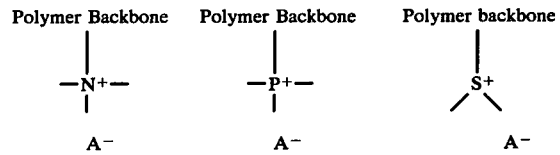

The anion, A−, of the onium salt is an anion of an acid which will not detrimentally attack the surface of the metal substrate being pretreated. By the expression "detrimentally attack" is meant an attack which will cause subsequent corrosion problems. Thus, halogen anions such as Cl− and Br− should not be used because metal substrates which have been pretreated with onium salts containing these anions rapidly corrode resulting in a loss of adhesion of a subsequently applied coating and in an unsightly appearance. Suitable anions are anions of weak acids such as weak organic acids, such as formate, acetate, propionate and lactate, and anions of other weak acids such as borate, carbonate and hydroxide.

Preferred onium salts for use in pretreatment are monomeric quaternary phosphonium salts. Examples are alkyl and mixed alkyl aryl phosphonium salts. Specific examples are ethyl triphenyl phosphonium acetate and tetrabutyl phosphonium acetate.

A second preferred onium salt is polymeric onium salt, particularly those derived from polyepoxides. These materials can be formed by reacting a polyepoxide with a tertiary amine salt. The reaction is conducted under conditions sufficient to provide the desired quaternary ammonium salt-containing polymers.

The polyepoxide is a polymeric material having repeating structural units and a 1,2-epoxy equivalency greater than 1.0, that is, in which the average number of 1,2-epoxy groups per polymer molecule is greater than 1. Examples of suitable polymeric polyepoxides are described in U.S. Pat. Nos. 2,467,171; 2,615,007; 2,716,123; 3,030,336; 3,053,855 and 3,075,999.

Particularly preferred polyepoxides are polyglycidyl ethers of polyphenols such as Bisphenol A. These may be produced by etherification of a polyphenol with epichlorohydrin or dichlorohydrin in the presence of alkali. The phenolic compound may be bis(4-hydroxyphenyl)-2,2-propane, 4,4′-dihydroxybenzophenone, bis(4-hydroxyphenyl)-1,1-isobutane; bis(4-hydroxytertiarybutylphenyl)-2,2-propane; bis(2-hydroxynaphthyl)methane, 1,5-hydroxynaphthalene or the like. Also, polyepoxides similarly produced from ephichlorohydrin and novolak-type phenol resins may be employed.

The polyepoxides prepared as described above are quaternized by reacting with a tertiary amine salt under controlled conditions so as to provide required onium salt moiety in the resultant reaction product. Examples of tertiary amine salts which may be employed to form the quaternary ammonium salt group-containing polymers include salts of weak acids. Examples of weak acids are weak organic acids such as lactic acid, acetic acid, formic acid, propionic acid and butyric acid and other weak acids such as water, carbonic acid and boric acid. Specific amine salts are dimethylethanolamine propionate, dimethylethanolamine lactate, dimethylethanolamine acetate and dimethylethanolamine butyrate.

The quaternary ammonium salt group-containing polyepoxide optionally can be used in combination with a curing agent such as a capped isocyanate. To be reactive with the curing agent, the polyepoxide should contain groups which are reactive with the curing agent. For example, with the polyisocyanate curing agent, the polyepoxide should contain active hydrogens such as hydroxyl groups. The polyisocyanate should be capped so that it will not react with the active hydrogen until after pretreatment is conducted and the pretreated article is heated to a temperature sufficient to unblock the blocked polyisocyanate.

The onium salt-containing material is usually dispersed or solubilized in a compatible vehicle for easy application to the metal substrate. By the term vehicle is meant a solvent or dispersing medium for the onium salt-containing material. Because of availability and cost, water is the preferred vehicle, although other liquids such as alcohols, ketones, esters and ethers can be used. Obviously mixtures of various liquids including water can be used. Preferably, water constitutes at least about 75 and preferably about 90 to 100 percent by weight of the vehicle. The concentration of the onium salt can be critical. If the concentration is too low, insufficient protection may be obtained. If the concentration is too high, corrosion resistance may again suffer. As a lower concentration limit, the treating composition should contain at least about 3 percent by weight of the onium salt material; the percentage by weight being based on total weight of the onium salt and vehicle. An upper concentration limit is difficult to specify and will depend on the particular onium salt used. In general, an upper limit of 25 percent can be recommended, although it should be realized that not all onium salts will perform satisfactorily at such high levels. A trial-and-error technique should be undertaken to determine what is the optimum onium salt concentration.

In the practice of the invention, the pretreating composition is applied to the surface of the metal substrate in any convenient manner such as by immersion, spraying or wiping the surface either at room temperature or at elevated temperature. The preferred way of pretreating the metal substrate is to form an aqueous dispersion or solution of the onium salt and then immerse the metal to be treated.

The times and temperatures of immersion can be critical, depending on the onium salt and its concentration, and on the identity of the metal substrate treated. In general, the metal article should be immersed at a bath temperature of about 25° to 50° C., preferably 40° to 45° C., for at least 5 seconds, usually for about 5 seconds to 5 minutes, followed by removal of the article from the bath, and optionally rinsing with deionized water. The article is then dried. Preferably, the article is dried with forced air, and then baked at elevated temperature.

After drying, the metal has sufficient corrosion protection so that it can be exposed to the atmosphere without danger of atmospheric oxidation on the surface. The metal substrate is then directly coated. The coating can be an adhesive coating or a protective coating such as a layer of paint.

The invention is particularly useful for treating ferrous metal substrates. The substrates can be untreated steel or steel which has been previously pretreated such as iron phosphated or zinc phosphated steel substrates.

The invention is further described in connection with the following examples, which are to be considered illustrative rather than limiting. All parts and percentages in the examples and throughout this specification are by weight unless otherwise stated.

EXAMPLE A

A quaternary ammonium salt group-containing resin was prepared from the following charge:

| Ingredient | Parts by Weight |
|---|---|
| EPON 1001[1] | 2400.0 |
| 2-ethyl hexanol | 294.0 |
| Dimethylethanolamine lactate | 327.2 |
| Deionized water | 168.8 |
| Deionized water | 590.0 |

[1]EPON 1001 is a polyglycidyl ether of Bisphenol A, having an epoxy equivalent of about 450 to 500, commercially available from Shell Chemical Company.

The EPON 1001 was charged to a reaction vessel and heated to 96° C., followed by the addition of 2-ethyl hexanol. The mixture was held at 100° C. for about 50 minutes followed by the addition of dimethylethanolamine lactate and the first portion of deionized water. The reaction mixture was digested for about 45 minutes at 85°–95° C. to clarify the mixture, followed by the addition of the second portion of deionized water. The resin had a calculated solids content of 70 percent.

EXAMPLES 1–6

The quaternary ammonium salt group-containing resin of Example A was dispersed in deionized water to form a 10 percent resin solids dispersion. Untreated and previously pretreated (iron phosphated) steel panels were dipped in the bath for 2 minutes, blown dry with air, optionally baked at 300° and 400° F. (149° and 204° C.) for 5 minutes and then coated with a thermosetting acrylic coating composition sold commercially by PPG Industries, Inc. under the trademark DURACRON 200. Coating was accomplished by drawing down to approximately 1 mil thickness with a draw bar. The coated sample was then baked for eight minutes at 400° F. (204° C.), scribed with an "X" and placed in a salt spray chamber at 100° F. (38° C.) at 100 percent relative humidity atmosphere of a 5 percent by weight aqueous sodium chloride solution for one week, after which the creepage from the scribe mark was measured and is reported in Table I below.

For the purposes of comparison, control panels of both untreated and iron phosphated steel which were not dipped in the pretreatment bath were also evaluated and the results are reported in Table I below.

Table I

| Example No. | Steel Panel | Pretreatment Conditions | Scribe Creepage in millimeter (mm) |
|---|---|---|---|
| Control A | untreated | none | complete delamination of coating |
| 1 | untreated | dipped for 2 minutes at 40° C. and blown dry | 8 |
| Control 2 | untreated | no pretreatment but panel baked for 5 minutes at 300° F. (149° C.) before coating | complete delamination of coating |
| 2 | untreated | dipped for 2 minutes at 40° C., blown dry and baked for 5 minutes at 300° F. (149° C.) | 9 |
| Control 3 | untreated | none, but panel baked for 5 minutes at 400° F. (204° C.) before coating | complete delamination of coating |
| 3 | untreated | dipped for 2 minutes at 40° C., blown dry and baked for 5 minutes at 400° F. (204° C.) | 1 |
| Control | iron phosphated | none | 5 |
| Control | iron phosphated with chromic acid rinse | none | 0.5 |
| Control | zinc phosphated | none | no scribe creepage |
| 4 | iron phosphated | 10 second dip at 40° C. drip dry at room temperature | complete delamination |
| 5 | iron phosphated | dipped for 10 seconds at 40° C., blown dry and baked for 5 minutes at 300° F. (149° C.) | 7.5 |
| 6 | iron phosphated | dipped for 10 seconds at 40° C., blown dry and baked for 5 minutes at 400° F. (204° C.) | 1.2 |

EXAMPLES 7-12

A series of untreated and iron phosphated steel panels were dipped in pretreatment dispersions such as described in Examples 1 and 3, with the exception that the pretreatment solutions contained a urethane crosslinker and catalyst in addition to the ammonium salt-containing resin. The pretreatment solution was prepared by mixing 214 parts of a 70 percent solids quaternary ammonium salt-containing resin of Example A with 50 parts of a urethane crosslinker and 3.17 parts of dibutyltin diacetate catalyst. The mixture was diluted with deionized water to form a 10 percent solids pretreatment bath.

The urethane crosslinker was the 2-ethyl hexanol capped adduct of the reaction product of 3 moles of 2,4-toluene diisocyanate and one mole of trimethylolpropane.

Pretreatment, coating and salt spray exposure was as generally conducted in Examples 1 through 6 in that the steel panels were dipped in the pretreatment bath for a specific period of time, usually blown dry and optionally baked at 300°-400° F. (149°-204° C.) for 5 minutes and then coated with the DURACRON 200 and baked. The samples were scribed, exposed to the salt spray fog for one week and then the creepage from the scribe mark measured. The results are reported in Table II below.

Table II

| Example No. | Steel Panel | Pretreatment Conditions | Scribe Creepage in mm |
|---|---|---|---|
| 7 | untreated | dipped for 2 minutes at 40° C. and blown dry | 10 |
| 8 | untreated | panel dipped for 2 minutes at 40° C., blown dry and baked for 5 minutes at 300° F. (149° C.) | 8.5 |
| 9 | untreated | panel dipped for 2 minutes at 40° C., blown dry and baked for 5 minutes at 400° F. (204° C.) | 2.5 |
| 10 | iron phosphated | panel dipped for 6 seconds at 40° C. and blown dry | 9.7 |
| 11 | iron phosphated | dipped for 10 seconds at 40° C., blown dry and baked for 5 minutes at 300° F. (149° C.) | 9 |
| 12 | iron phosphated | dipped for 10 seconds at 40° C., blown dry and baked for 5 minutes at 400° F. (204° C.) | 4 |

EXAMPLES 13-27

A series of steel panels, both untreated and iron phosphated, were dipped in a 5 percent solids pretreatment bath of ethyl triphenyl phosphonium acetate. Pretreatment conditions were varied as reported in Table III below. The pretreated panels were coated and the coating baked, scribed and exposed to a salt spray fog as described in Examples 1–3. After one week exposure, the scribe creepage was measured and the results are reported in Table III below.

Table III

| Example No. | Steel Panel | Pretreatment Conditions | Scribe Creepage in mm |
|---|---|---|---|
| 13 | untreated | dipped for 5 minutes at bath temperature of 60° C., drip dried at room temperature | 34 |
| 14 | untreated | dipped for 5 minutes at 60° C., rinsed with deionized water and blown dry | 9 |
| 15 | untreated | same as Example 14, but sample baked at 400° F. (204° C.) for 5 minutes after blowing dry | 2 |
| 16 | iron phosphated | dipped for 10 seconds at 60° C., drip dried at room temperature | 25 |
| 17 | iron phosphated | same as Example 16, but panel baked for 5 minutes at 400° F. (204° C.) after drip drying | 23 |
| 18 | iron phosphated | dipped for 10 seconds at 60° C., rinsed with deionized water and blown dry | 3 |
| 19 | iron phosphated | same as Example 18, but panel baked for 5 minutes at 400° F. (204° C.) after blowing dry | 0.7 |
| 20 | untreated | dipped for 5 minutes at 25° C. rinsed with deionized water and blown dry | 16 |
| 21 | untreated | same as Example 14, but panel baked at 400° F. (204° C.) for 5 minutes after blowing dry | 20 |
| 22 | iron phosphated | dipped for 6 seconds at 25° C., rinsed with deionized water and blown dry | 3.8 |
| 23 | iron phosphated | same as Example 22, but panel baked for 5 minutes at 400° F. (204° C.) after blowing dry | 2.3 |
| 24 | untreated | dipped for one minute at 40° C., blown dry, rinsed with deionized water and blown dry | 8.5 |
| 25 | untreated | same as Example 24, but panel baked for 5 minutes at 400° F. (204° C.) after last blow dry | 8.5 |
| 26 | iron phosphated | dipped for 6 seconds at 40° C., blown dry, rinsed with deionized water, blown dry | 2 |
| 27 | iron phosphated | same as Example 26, but panel baked for 5 minutes at 400° F. (204° C.) after last blow dry | 0.6 |

EXAMPLES 28 and 29

Two iron phosphated steel samples were dipped in a pretreatment bath of a 5 percent solids solution of ethyl triphenyl phosphonium iodide. Pretreatment conditions were as reported in Table IV below. The pretreated panels were coated, the coating baked, scribed and exposed to a salt spray fog as generally described in Examples 1–3. After one week exposure to the salt spray fog, scribe creepage was measured and the results are reported in Table IV below.

Table IV

| Example No. | Pretreatment Conditions | Scribe Creepage in mm |
|---|---|---|
| 28 | dipped for 5 minutes at bath temperature of 80° C. and blown dry | 0.5 |
| 29 | same as Example 28, but sample baked for 5 minutes at 400° F. (204° C.) after blowing dry | 20 |

EXAMPLES 30–38

A series of steel panels, both untreated and iron phosphated, were dipped in a pretreatment bath of a 5 percent solids solution of tetrabutyl phosphonium acetate. Pretreatment conditions were as reported in Table V below. The pretreated panels were coated, the coating baked, scribed and exposed to salt spray fog as generally described in Examples 1–3. After one week exposure to the salt spray fog, the scribe creepage was measured and the results reported in Table V below.

Table V

| Example No. | Steel Panel | Pretreatment Conditions | Scribe Creepage in mm |
|---|---|---|---|
| 30 | untreated | dipped for 5 minutes at 25° C., blown dry, rinsed with deionized water and blown dry | 6 |
| 31 | untreated | same as Example 30, but panel dipped for only one minute | 9 |
| 32 | untreated | dipped for one minute at 25° C., rinsed with deionized water and blown dry | 8 |
| 33 | iron phosphated | dipped for 6 seconds at 25° C., rinsed with deionized water and blown dry | 0.9 |

Table V-continued

| Example No. | Steel Panel | Pretreatment Conditions | Scribe Creepage in mm |
|---|---|---|---|
| 34 | iron phosphated | dipped for 12 seconds at 25° C., rinsed with deionized water and blown dry | 1.8 |
| 35 | untreated | dipped for 5 minutes at 40° C., blown dry, rinsed with deionized water and blown dry | 8 |
| 36 | untreated | same as Example 35, except panel baked for 5 minutes at 400° F. (204° C.) after second blow dry | 6 |
| 37 | iron phosphated | dipped for 6 seconds at 40° C., rinsed with deionized water and blown dry | 0.6 |
| 38 | iron phosphated | same as Example 37, but panel dipped for 12 seconds | 1.5 |

A series of experiments, similar to those of Examples 30–38 above, were conducted with a 20 percent solids tetrabutyl phosphonium acetate pretreatment solution instead of the 5 percent solution used in the above examples. In all instances, the results were very poor, resulting in extensive scribe creepage and delamination from the scribe mark to complete delamination of the coating.

EXAMPLE B

A ternary sulfonium salt group-containing resin was prepared from the following charge:

| Ingredient | Parts by Weight |
|---|---|
| EPON 829[1] | 1389.6 |
| Bisphenol A | 448.6 |
| PCP 0200[2] | 364.7 |
| Benzyl dimethylamine | 4.7 |
| 75 percent aqueous lactic acid solution | 6.3 |
| Phenyl CELLOSOLVE[3] | 336.8 |
| TEXANOL[4] | 214.8 |
| bis-(2-hydroxyethyl) sulfide[5] | 180.6 |
| Lactic acid[5] | 178.0 |
| Deionized water[5] | 157.7 |
| Ethyl CELLOSOLVE[6] | 157.7 |

[1]Polyglycidyl ether of Bisphenol A, having an epoxy equivalent of about 193 to 203, commercially available from Shell Chemical Company.
[2]Polycaprolactone diol having a molecular weight of about 530, commercially available from Union Carbide Corporation.
[3]Ethylene glycol monophenyl ether.
[4]2,2,4-trimethyl pentanediol-1,3-monoisobutyrate.
[5]Solution of the three ingredients.
[6]Ethylene glycol monoethyl ether.

The EPON 829 was charged to a reaction vessel and heated to exotherm for 1 hour. PCP 0200 and benzyl dimethylamine were charged and the reaction mixture heated to 130° C. and held at this temperature until a Gardner-Holdt viscosity of X+ (measured at 25° C. at 50 percent solids in ethyl CELLOSOLVE) was attained. The phenyl CELLOSOLVE, ethyl CELLOSOLVE, TEXANOL and lactic acid were then charged to the reaction vessel and the mixture digested while cooling to 100° C. for 5 minutes. The solution of bis-(2-hydroxyethyl) sulfide, lactic acid and deionized water was then added over 15 minutes. The reaction mixture was digested for 1 hour at 85°–90° C. to clarify the resin. The final product had a calculated solids of 71.8 and an epoxy equivalent of 2920.

Two hundred eight (208.9) parts of the ternary sulfonium resin was combined with 50 parts of a urethane crosslinker and 3.17 parts of dibutyltin diacetate catalyst and diluted to 2000 parts with deionized water to form a 10 percent resin solids pretreatment bath.

The urethane crosslinker was that described above in connection with Examples 7 through 12.

EXAMPLES 39–41

A series of untreated steel panels were dipped in the 10 percent resin solids pretreatment bath of Example B at a bath temperature of 40° C. Pretreatment conditions were as reported in Table VI below. The pretreated panels were coated, the coating baked, scribed and exposed to the salt spray fog as generally described in Examples 1–3. After 1 week exposure, the scribe creepage was measured and the results are reported in Table VI below.

Table VI

| Example No. | Pretreatment Conditions | Scribe Creepage in mm |
|---|---|---|
| 39 | 5 minute dip at 40° C., blown dry and baked 5 minutes at 300° F. (149° C.) | 6 |
| 40 | 5 minute dip at 40° C., drip dried at room temperature and baked 5 minutes at 300° F. (149° C.) | 5 |
| 41 | 5 minute dip at 40° C. and baked 5 minutes at 300° F. (149° C.) | 4 |

EXAMPLE 42

A zinc phosphated steel panel was pretreated with a 10 percent quaternary ammonium salt group-containing resin used in Examples 1 through 6. Pretreatment consisted of dipping the panel in a pretreatment bath at a temperature of 40° C., blowing the panel dry and then baking for 5 minutes at 400° F. (204° C.). The pretreated panel was then cathodically electrodeposited with a cationic water base paint at 350 volts for approximately 120 seconds. The electrodeposited coating was cured at 350° F. (177° C.) for 25 minutes to produce a cured film of 0.55 mil thickness. The coated panel was scribed and exposed to a salt spray fog for 10 days. The scribe creepage was 1.6 mm. For purposes of control, a zinc phosphated steel panel with no additional pretreatment was electrocoated, cured, scribed and exposed to a salt spray fog under the same conditions. The scribe creepage was 4.7 mm after 10 days of exposure to salt spray fog.

EXAMPLE C

A quaternary ammonium salt group-containing resin with hydroxyl counter-ion was prepared from the following charge:

| Ingredient | Parts by Weight |
|---|---|
| EPON 1001 | 528 |
| 2-ethyl hexanol | 53.6 |
| Dimethylethanolamine[1] | 89 |
| Deionized water[1] | 29.6 |
| Deionized water | 39.4 |

-continued

| Ingredient | Parts by Weight |
|---|---|
| Deionized water | 141.8 |

[1]Solution of the two ingredients.

The EPON 1001 was charged to the reaction vessel and heated to 96° C. to melt the resin, followed by the addition of the 2-ethyl hexanol. The mixture was held at 133° C. for about 1 hour, followed by the addition of the dimethylethanolamine dissolved in the first portion of deionized water. The reaction mixture then began to exotherm and the second and third portions of deionized water were added sequentially. Additional cooling was needed to control the exotherm and about 500 ml of additional deionized water was added for this purpose which reduced the solids content of the reaction mixture to 43.8 percent.

The resultant resin was found to contain 74.8 percent quaternary ammonium hydroxide groups based on total weight of base. The total base groups including quaternary ammonium and amine groups present in the resin can be determined according to the method described in U.S. Pat. No. 3,839,252 to Wismer et al, col. 12, lines 30–57. Also, an ion-exchange technique can be used. With this technique, the resin sample is dissolved in a 20/80 volume percent propylene glycol, tetrahydrofuran mixture and passed through a bed of strong base (hydroxide form) ion exchange resin. The eluted resin sample contains the quaternary ammonium hydroxide form of the resin and the amine. When titrated with standardized hydrochloric acid, the two bases are sufficiently different in strength to yield two widely separated breaks in the titration curve produced by an automatic potentiograph. The total amount of hydrochloric acid consumed corresponds to the total base groups of the system. The amount of hydrochloric acid required to produce the first break in the titration curve yields the amount of quaternary ammonium species present. The difference between the total HCl consumed and that required for the quaternary ammonium group corresponds to the hydrochloric acid required for neutralization of the amine.

EXAMPLES 43–50

The quaternary ammonium salt group-containing resin of Example C was dispersed in deionized water to form a 10 percent resin solids immersion bath. Untreated and iron phosphated steel panels were immersed in the bath at a bath temperature of 40° C. and pretreated at varying conditions as described in Table VII below. The pretreated panels were coated, baked, scribed and exposed to the salt spray fog as generally described in Examples 1 through 3. After one week exposure, the scribe creepage was measured and the results are reported in Table VII below.

Table VII

| Example No. | Steel Panel | Pretreatment Conditons | Scribe Creepage in mm |
|---|---|---|---|
| 43 | untreated | dipped for 2½ minutes and blown dry | 9 |
| 44 | untreated | dipped for 2½ minutes, blown dry and baked for 5 minutes at 300° F. (149° C.) | 2.5 |
| 45 | untreated | dipped for 2½ minutes, rinsed with deionized water and blown dry | 9 |
| 46 | iron phosphated | dipped for 6 seconds and blown dry | 3.8 |
| 47 | iron phosphated | dipped for 6 seconds, blown dry and baked for 5 minutes at 300° F. (149° C.) | 3 |
| 48 | iron phosphated | dipped for 6 seconds, blown dry and baked for 5 minutes at 400° F. (204° C.) | 1.2 |
| 49 | iron phosphated | dipped for 6 seconds, rinsed with deionized water and blown dry | 5 |
| 50 | iron phosphated | dipped for 6 seconds, rinsed with deionized water, blown dry and baked for 5 minutes at 400° F. (204° C.) | 5 |

We claim:

1. A method of providing improved corrosion resistance to ferrous metal substrates, comprising:

A. passivating the surface of the substrate by pretreatment with an at least 3 percent by weight dispersion or solution in a compatible vehicle of an onium salt selected from the class consisting of:

$$(R)_4N^+A^-,\ (R)_4P^+A^-,\ (R)_3S^+A^-$$

where R are organic radicals and A is an anion of a weak acid which will not detrimentally attack the surface of the ferrous substrate, followed by B. directly coating the pretreated metal surface with an adhesive or protective coating material.

2. The method of Claim 1 in which the onium salt is selected from the class consisting of $(R)_4N^+A^-$ and $(R)_4P^+A^-$.

3. The method of claim 1 in which the anion is selected from the class consisting of formate, acetate, propionate, lactate, borate, carbonate and hydroxyl.

4. The method of claim 1 in which the onium salt is polymeric.

5. The method of claim 4 in which the polymer is a polyepoxide.

6. The method of claim 5 in which the onium salt is a quaternary ammonium salt of a polyglycidyl ether of a polyphenol.

7. The method of claim 1 in which the onium salt is monomeric.

8. The method of claim 7 in which the onium salt is a phosphonium salt.

9. The method of claim 8 in which the phosphonium salt is selected from the class consisting of ethyl triphenyl phosphonium acetate and tetrabutyl phosphonium acetate.

10. The method of claim 1 in which the onium salt is in an aqueous medium.

11. The method of claim 10 in which the aqueous medium contains at least 75 percent water.

12. The method of claim 10 in which the metal substrate is first immersed in an aqueous composition of the onium salt, removed therefrom, optionally rinsed with deionized water, dried and subsequently coated.

13. A metal article coated by the method of claim 1.

14. A metal article coated by the method of claim 1.

15. The method of claim 1 in which the ferrous metal substrate is iron phosphated before the passivating pretreatment.

16. A metal article coated by the method of claim 15.

17. The method of claim 1 in which the metal substrate is zinc phosphated before the passivating pretreatment.

18. A metal article coated by the method of claim 1.

* * * * *

UNITED STATES PATENT AND TRADEMARK OFFICE

CERTIFICATE OF CORRECTION

PATENT NO. : 4,053,329

DATED : October 11, 1977

INVENTOR(S) : Nicholas T. Castellucci and Joseph F. Bosso

It is certified that error appears in the above-identified patent and that said Letters Patent are hereby corrected as shown below:

Column 2, line 66, delete "to" within the chemical formula.

Column 6, line 35, "500" should be --550--.

Column 15, line 7, "1" should be --17--.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*